US007002306B2

(12) United States Patent
Cull et al.

(10) Patent No.: US 7,002,306 B2
(45) Date of Patent: Feb. 21, 2006

(54) LAMP DRIVER SYSTEM WITH IMPROVED REDUNDANCY

(75) Inventors: Brian D. Cull, Glendale, AZ (US); Elias S. Haim, Glendale, AZ (US); Allan E. Harris, Phoenix, AZ (US); John F. Schmidt, Phoenix, AZ (US)

(73) Assignee: Honeywell International Inc., Morristown, NJ (US)

( * ) Notice: Subject to any disclaimer, the term of this patent is extended or adjusted under 35 U.S.C. 154(b) by 157 days.

(21) Appl. No.: 10/699,388

(22) Filed: Oct. 31, 2003

(65) Prior Publication Data

US 2005/0093461 A1 May 5, 2005

(51) Int. Cl.
*H05B 37/02* (2006.01)

(52) U.S. Cl. ..... 315/291; 315/149; 315/312

(58) Field of Classification Search ..... 315/149–159, 315/312, 316, 318, 320, 324, 291, 224, 225, 315/307, 294

See application file for complete search history.

(56) References Cited

U.S. PATENT DOCUMENTS 4,625,152 A * 11/1986 Nakai ..... 315/317
4,998,045 A 3/1991 Ruby ..... 315/209 R
5,027,034 A 6/1991 Ruby et al. ..... 315/106
5,811,942 A * 9/1998 Pedretti ..... 315/312
RE35,994 E * 12/1998 Lestician ..... 315/291
6,118,415 A 9/2000 Olson ..... 345/41
6,404,143 B1 * 6/2002 Pilz et al. ..... 315/294
6,404,145 B1 * 6/2002 Saito ..... 315/307

* cited by examiner

*Primary Examiner*—Wilson Lee
(74) *Attorney, Agent, or Firm*—Andrew A. Abeyta

(57) ABSTRACT

A lamp driver system that facilitates improved reliability and performance for a display system is provided. The lamp driver system includes a fault detector and an output steering device. The fault detector determines when a failure occurs in a lamp illuminating the display system. The output steering device selectively drives the lamps to illuminate the display system. Specifically, when a failure in a first lamp is detected by the fault detector, the output steering device is used to selectively drive a second lamp to provide the needed illumination to the display system. The lamp driver system thus can provide redundancy in the display system by automatically switching to a backup lamp when a failure in the first lamp is detected. This redundancy can improve the reliability and performance of the display system.

19 Claims, 3 Drawing Sheets

LAMP DRIVER SYSTEM WITH IMPROVED REDUNDANCY

FIELD OF THE INVENTION

This invention generally relates to displays, and more specifically applies to improved reliability in displays.

BACKGROUND OF THE INVENTION

Various types of optical displays are commonly used in a wide variety of applications. In many applications, the reliability of the display is of critical importance. For example, in vehicles such as aircraft, optical displays can be used to provide important performance and safety information to the operator. In these applications, the critical nature of the information provided to operator demands high performance and reliability from the optical display.

Unfortunately, many optical display systems have limited reliability. In these displays, the failure of one critical part can render the entire display inoperable. For many applications, this can lead to unacceptably high failure rates. For example, electronic displays are commonly used in aircraft to provide a wide range of critical information to the crew. In such aircraft applications, the reliability of the display is of utmost importance, and even very low failure rates can be unacceptable.

One area where optical displays can exhibit failure is in the lamp illuminating the display. Display lamps can fail in many ways. As one example failure mode, typical fluorescent lamps can fail when one of the cathodes providing electrical charge to the lamp breaks down. When the cathode begins to fail, the performance of the lamp can quickly degrade and in many cases is rendered totally inoperable. In many applications, even a partial degradation of lamp performance can unacceptably degrade the performance of the display. Furthermore, in most cases a complete failure in the lamp illuminating the display will render the display totally inoperable. Again, in applications such as aircraft displays, such failures can be unacceptable even at very low failure rates.

Thus, what is needed is an improved lamp driver system that provides the improved performance and reliability needed for critical applications.

BRIEF SUMMARY OF THE INVENTION

The present invention provides a lamp driver system that facilitates improved reliability and performance for a display system. The lamp driver system includes a fault detector and an output steering device. The fault detector determines when a failure occurs in a lamp illuminating the display system. The output steering device selectively drives the lamps to illuminate the display system. Specifically, when a failure in a first lamp is detected by the fault detector, the output steering device is used to selectively drive a second lamp to provide the needed illumination to the display system. The lamp driver system thus can provide redundancy in the display system by automatically switching to a backup lamp when a failure in the first lamp is detected. This redundancy can improve the reliability and performance of the display system.

The foregoing and other objects, features and advantages of the invention will be apparent from the following more particular description of a preferred embodiment of the invention, as illustrated in the accompanying drawings.

BRIEF DESCRIPTION OF DRAWINGS

The preferred exemplary embodiment of the present invention will hereinafter be described in conjunction with the appended drawings, where like designations denote like elements, and.

DETAILED DESCRIPTION OF THE INVENTION

The present invention provides a lamp driver system that facilitates improved reliability and performance for a display system. The lamp driver system includes a fault detector and an output steering device. The fault detector determines when a failure occurs in a lamp illuminating the display system. The output steering device selectively drives the lamps to illuminate the display system. Specifically, when a failure in a first lamp is detected by the fault detector, the output steering device is used to selectively drive a second lamp to provide the needed illumination to the display system. The lamp driver system thus can provide redundancy in the display system by automatically switching to a backup lamp when a failure in the first lamp is detected. This redundancy can improve the reliability and performance of the display system.

In general, lamp driver systems are used to power lamps used in display systems. As one example, lamp driver systems are used to drive fluorescent lamps used for backlighting flat panel displays (e.g., LCD's) used in a variety of applications. Fluorescent lamps typically comprise an enclosure (e.g., glass tube) with an electrode at each end and filed with a noble gas such as mercury or argon. The inner surface of the glass tube is coated with phosphor. The lamp driver provides a drive voltage across the electrodes, causing the noble gas atoms to emit ultraviolet photons. The emitted photons, in turn, excite the phosphorus, creating fluorescent illumination. In other examples, the lamps can comprise other types of illumination lamps, including LED's, electromagnetic emitters (such as infrared, ultraviolet, ultrasonic), and arc lamps.

Figure 1:
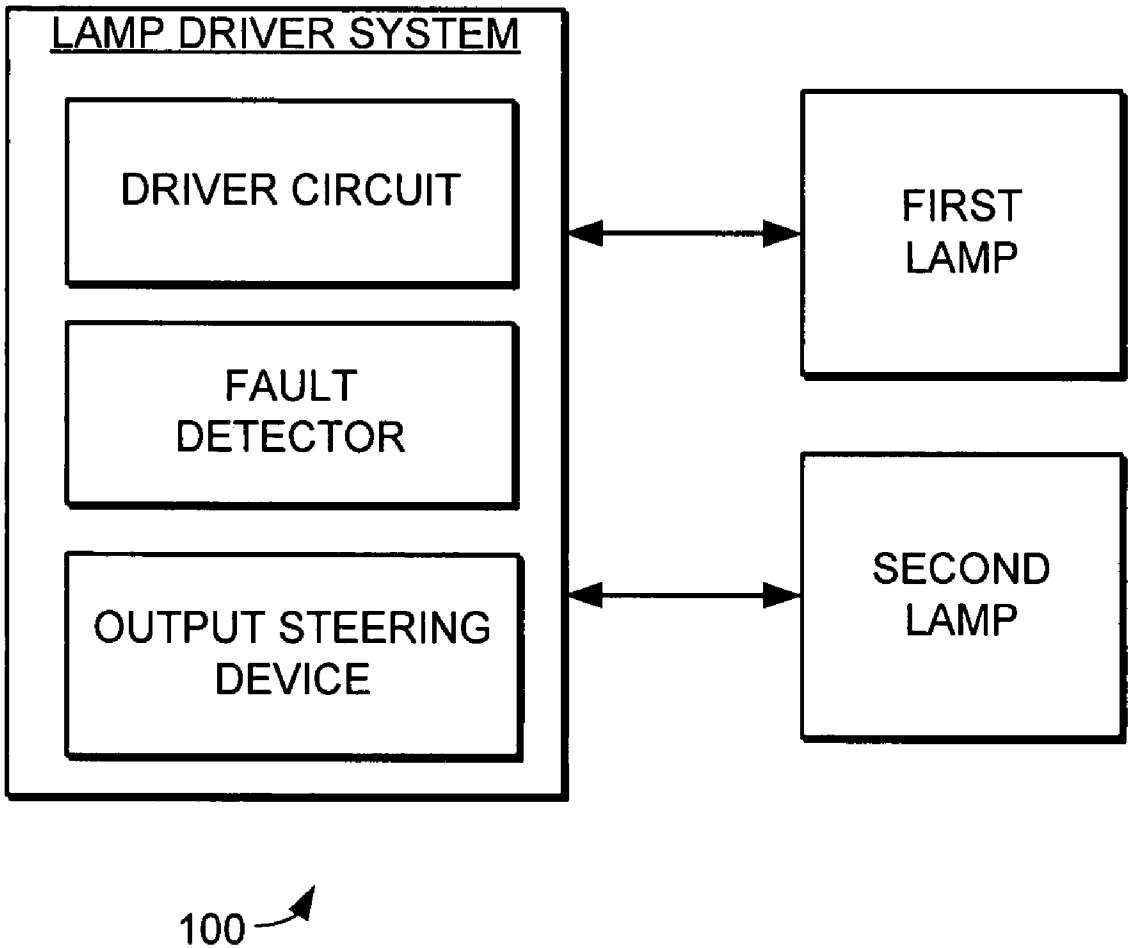
FIG. 1 is a schematic view of a lamp driver system.

Turning now to FIG. 1, a lamp driver system 100 is illustrated. The lamp driver system includes a lamp power control circuit commonly called a driver circuit, a fault detector and an output steering device. The driver circuit generates the drive voltage which is applied to the electrodes to light the lamps. The driver circuit can be of any suitable type, including the various topologies used in currently available systems. On exemplary driver circuit is described in U.S. Pat. No. 5,027,034 entitled "Alternating Cathode Florescent Lamp Dimmer" issued to Joseph Ruby et al and assigned to Honeywell Inc.

To facilitate improved reliability and performance, the driver system 100 also includes a fault detector and an output steering device. The fault detector determines when a failure occurs in a lamp illuminating the display system, and the output steering device selectively drives the lamps to illuminate the display system. The fault detector can be implanted using photo detectors or other measurements of lamp output or status, as well as with measurements from the driver circuits themselves. The fault detector can be implemented with a variety of different devices and techniques.

As one example, the fault detector can be implemented with a programmable device such a microcontroller, a complex programmable logic device (CPLD), field programmable gate array (FPGA) and/or application specific integrated circuit (ASIC). In the microcontroller example, the microcontroller implementing the fault detector would receive the various measurements of lamp output or status and use algorithms in the microcontroller's operational program to monitor lamp operation and determine when a fault has occurred in one or more of the lamps. This embodiment can also use other peripheral components designed to work with the microcontroller. Such components can include, but are not limited to, analog to digital converters, digital to analog converters, memory devices, and programmable logic devices. Outputs on the microcontroller can be used to control the lamp driver circuitry by inhibiting operation of specific functions, or all functions, depending upon the complexity of the fault detection system design.

The output steering device selectively drives the lamps to illuminate the display system. The output steering device thus determines which lamp is driven by the driver circuit device, and thus controls which lamp is used to illuminate the display. As one example implementation, the output steering device can be implemented with the same microcontroller that provides fault detection. By making both fault detection and output steering visible to the microcontroller's operational program, it is possible to produce various implementations of fault detection and output steering through simple program changes in the microcontroller. The microcontroller thus enables either, or both lamps based on the operating characteristics and fault detection methods that have been incorporated into the microcontroller's operational program.

For example, when a failure in a first lamp is detected by the fault detector, the output steering device is used to selectively drive a second lamp to provide the needed illumination to the display system. The lamp driver system 100 thus can provide redundancy in the display system by automatically switching to a backup lamp when a failure in the first lamp is detected. This redundancy can improve the reliability and performance of the display system.

Figure 2:
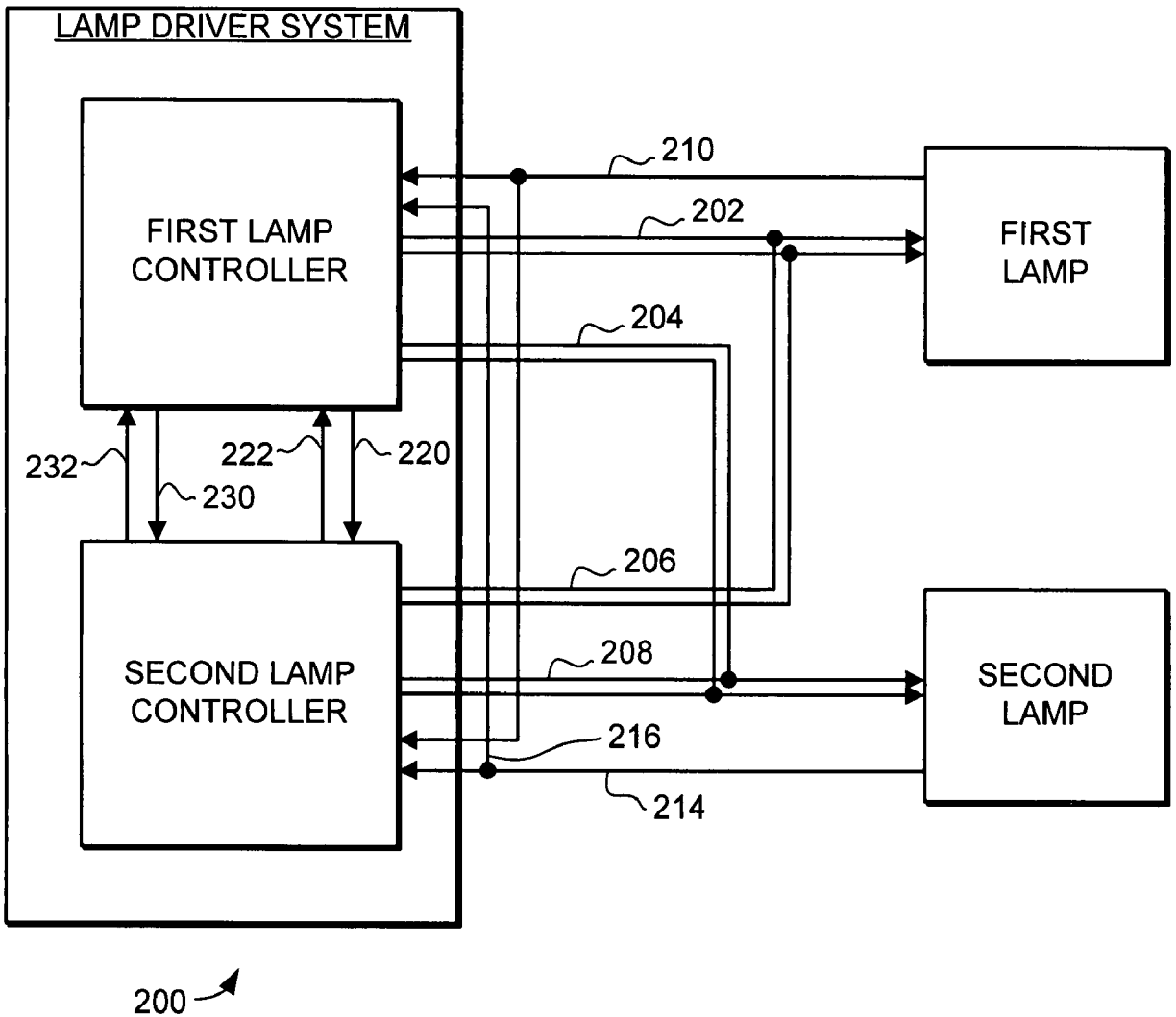
FIG. 2 is a schematic view of a lamp driver system first embodiment.

Turning now to FIG. 2, a second embodiment exemplary lamp driver system 200 is illustrated. Lamp driver system 200 includes a first lamp controller and a second lamp controller, which are selectively used to drive a first lamp and a second lamp. As will be described in greater detail later, each controller in the drive system 200 preferably includes the devices and circuits needed to drive the lamps. The driver system 200, like the driver system 100, facilitates the ability to switch between lamps. Thus, if the first lamp fails, the driver system 200 can instead drive the second lamp to provide the light needed by the display. In addition to providing this type of redundancy, the driver system 200 also provides lamp controller redundancy. Thus, if a failure occurs in a lamp controller, the other lamp controller can drive the lamp to provide the need illumination. It is important to note in the lamp driver system 200, either lamp controller can driver either lamp. Thus, the first lamp controller can selectively drive both the first lamp and/or the second lamp. Likewise, the second lamp controller can selectively drive both the first lamp and/or the second.

Taken together, the lamp system 200 provides dual redundancy. Thus, the lamp system 200 can switch between lamps to compensate for failure in a lamp, and the lamp system 200 can switch between lamp controllers to compensate for failure in a controller.

To facilitate this dual redundancy, the lamp system 200 includes several feedback, control and drive paths. Specifically, the lamp system 200 includes a drive path 202 from the first lamp controller to the first lamp, a drive path 204 from the first lamp controller to the second lamp, a drive path 206 from the second lamp controller to the first lamp, and a drive path 208 from the second lamp controller to the second lamp. These drive paths provide the electrical connections used by the controllers to selectively drive the two lamps.

The lamp system 200 also includes an optical feedback path 210 from the first lamp to the first controller, an optical feedback path 212 from the first lamp to the second controller, an optical feedback path 214 from the second lamp to the second controller, and an optical feedback path 216 from the second lamp to the first controller. These optical feedback paths are used by the controllers to determine the amount of light being produced by the lamps. In response to the optical feedback, the controllers adjust the drive of the lamps to output the desired amount of light.

The lamp system 200 also includes a controller feedback path 220 from the first controller to the second controller, and a controller feedback path 222 from the second controller to the first controller. The controller feedback paths are used to provide status information between controllers. Thus, through controller feedback path 220 the second controller can learn the health and status of the first controller. Likewise, through controller feedback path 222 the first controller can learn the health and status of the second controller. This information can be used by the controllers to determine if a new controller needs to be activated to drive a lamp due to failure in the other controller.

In an exemplary implementation, one lamp controller would be selected as a primary, and would remain as primary until performance drops below a defined level. Using the controller feedback path, the secondary controller could then be activated to take over for the failed primary controller. In addition to switching controllers to compensate for failures, the switching could also occur for testing or simply to balance wear in the devices.

The lamp driver system 200 also includes a control signal path 230 from the first controller to the second controller, and a control signal path 232 from the second controller to the first controller. The control signal paths are used by the controllers to control the operation of the other controller. For example, in situations where a partial failure occurs in the primary controller, the primary controller may continue to operate at sub-optimal levels. In this situation, the control signal can be used to fully disable the faulty primary controller such that the secondary controller can then take over without interference from the faulty primary controller.

As one embodiment of the invention, the first and second lamp controllers can include one or more microcontrollers, whose function includes fault detection and output steering. In this embodiment, the microcontroller would be programmed with fault detection and switch algorithms used to determine which lamp is driven by which controller.

In one specific embodiment, each lamp controller includes a microcontroller that provides fault detection and output steering for its corresponding lamp controller. In this embodiment, the microcontroller in the primary lamp controller can determine which lamp must be operated, based on a combination of lamp feedback and feedback from the secondary controller. If the fault detection algorithm determines that the primary lamp is not operating correctly, then the primary controller will enable the secondary lamp. If the secondary lamp's operation cannot be initiated, the secondary controller determines that the primary controller is defective. The secondary controller disables the primary controller, and initiates operation with the primary lamp. If the primary lamp does not work, then the secondary controller switches to the secondary lamp. An example of such an implementation will be described in more detail below.

It should again be noted that the embodiment illustrated in FIG. 2 is just one example of how lamp driver system with multiple controllers can be implemented, and that many variations in paths between controllers and lamps are possible.

Figure 3:
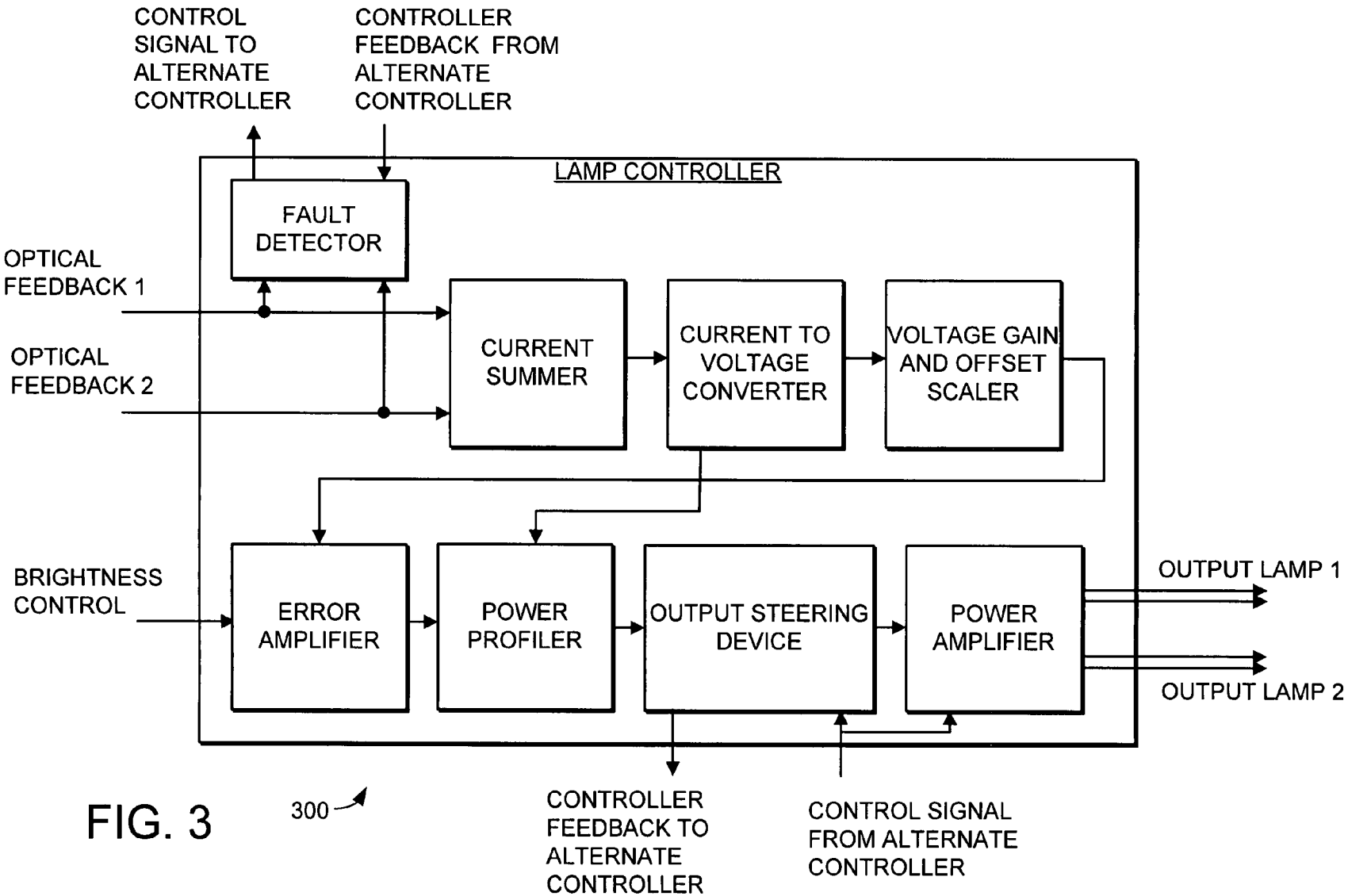
FIG. 3 is a schematic view of a lamp controller first embodiment.

Turning now to FIG. 3, an exemplary lamp controller 300 is illustrated. It should first be noted that as to the details of the lamp controller operation it can be implemented in many different configurations, and that the lamp controller can use any of the various types of devices and circuit topologies to produce the drive signals used to operate the lamp. Thus, the lamp controller 300 is only one example of the type of lamp controller that can be used in a lamp driver system, such as lamp driver system 200. The lamp controller 300 includes a fault detector, a current summer, a current-to-voltage converter, a voltage gain and offset scalar, an error amplifier, a power profiler, output steering device, and a power amplifier. The lamp controller 300 receives optical feedback 1 and optical feedback 2 from the lamps, and receives a controller feedback signal and control signal from the alternate controller. The lamp controller outputs a control signal and controller feedback to the alternate controller, and selectively outputs drive signals to lamp 1 and lamp 2.

The general operation of the controller is as follows. The controller receives optical feedback from the lamps and passes that feedback to the current summer. Generally, that optical feedback signal is current varying signal, with the current in the optical feedback signal being proportional to the light measured at the feedback sensor. At the current summer, the optical feedback signals are summed to generate a total feedback signal. That total feedback signal is passed to the current-to-voltage converter. The current-to-voltage converter converts the current driven signal to a corresponding voltage driven signal. That voltage signal is passed to the voltage gain and offset scalar that adjusts the range of the voltage signal to the appropriate scale. The adjusted signal is then passed to the error amplifier that compares the scaled voltage signal to a brightness control signal that corresponds to the desired lamp output. If there is a difference between the measured and desired values, the error amplifier drives the power profiler to adjust the output of the lamp. The output of the power profiler is passed to through the output steering device to the amplifier. The amplifier then produces the needed lamp signal used to drive the lamp, with the output steering device determining which lamp is driven by the controller 300. The output steering device determines if the output power produced by the amplifier is passed to the first lamp, the second lamp, or a combination of both.

To facilitate output steering, the power amplifier preferably includes two output channels that can be selectively utilized. This can be provided in the form of two separate amplifiers, or as two separate amplifiers that share some components, or it can be implemented as one amplifier with multiple outputs. The output steering device is then used to control which output of the amplifier is driven by the signal from the power profiler.

The fault detector again serves several purposes. First, the fault detector receives the optical feedback signals from the feedback sensors. From the optical feedback signals, the fault detector can determine the lamp output of each lamp. Thus, the fault detector can determine if the lamps are outputting the appropriate levels of light.

The fault detector also receives a controller feedback signal. The controller feedback signal provides status information between controllers. Thus, from the controller feedback signal the controller can learn the health and status of the other controllers in the system. This information can be used by the controllers to determine if a new controller needs to be activated to drive a lamp due to failure in the other controller.

From the optical feedback signals and controller feedback signals, the fault detector generates a control signal. The control signal is used by the controller to selectively control the operation of the other controller. For example, in situations where a partial failure occurs in the primary controller, the primary controller may continue to operate at sub-optimal levels. In this situation, the control signal is generated by the fault detector to fully disable the faulty primary controller such that the secondary controller can then take over without interference from the faulty primary controller.

Again, the fault detector and output steering device can be implemented with a microcontroller, as was described above. In this embodiment, the microcontroller would be programmed with fault detection and switching algorithms used to determine which lamp is driven by which controller. As one example, the microcontroller outputs to the power amplifier can be pulse width modulated (PWM) waveforms of variable frequency and duty cycle. These PWM waveforms can then be selectively steered to the lamps using a switch incorporated in the power amplifier. Additionally, by connecting the PWM signal of one microcontroller into the Capture/Compare input of the alternate microcontroller, the microcontrollers can monitor each other. When the PWM signal is disrupted (e.g., goes to static DC level), a failure has occurred in the controller. Thus, when the PWM output of the primary controller is detected at a DC level by the secondary controller, the secondary controller has detected a fault in the primary controller. When a failure in one controller has been detected, the other controller can disable the failed controller using the control signal to inhibit its further operation, and the other controller will assume fault detection and output steering responsibility.

Thus, the PWM signal of one microcontroller is sensed by the alternate microcontroller to determine if a failure has occurred. This validation path can determine failure whether the failure is before and up to the microcontroller, or after the microcontroller in the circuit.

To implement the control signals, two discrete outputs from each microcontroller can be used, with the first output comprising a primary control signal and the second output comprising a secondary control signal. As an example, output 1 of each microcontroller feeds into the first controller's power amplifiers control inputs by way of an "and" gate. That way, either microcontroller can drive the first controller's power amplifier's control signal to the active state, assuming that an active low signal is needed. Both microcontrollers thus have to send the disable signal to the power amplifier to disable its normal operation. Likewise, output 2 from each microcontroller is connected to the second controller's power amplifier control input, and thus both microcontrollers can control its operation.

As one example method, the primary microcontroller drives its output 1 to a low, to turn the lamp power on for lamp 1. If it detects insufficient light output, it drives output 2 low, and output 1 high to switch to drive lamp 2. If there is still not enough light, then microcontroller 2 assumes that microcontroller 1 has become in operational. Microcontroller 2 then drives output 1 low, to attempt to operate the first lamp itself. If that doesn't work, then it drives output 2 low, so that lamp 2 can be powered. If that does not work, then both lamps are defective, or both power amps are defective.

The lamp driver system can be adapted to operate with many different lamp systems. For example, various types of fluorescent lamps can be used, including tubular fluorescent lamps and flat fluorescent lamps. To fully facilitate the lamp driver system, multiple lamps are provided. The lamp driver system can then drive these multiple lamps selectively to provide for redundancy. The multiple lamps can comprise separate lamps of the same or different types. Additionally, the multiple lamps can comprise dual lamps. For example, they can comprise dual aperture lamps such as those described in the co-pending patent application "Redundant Aperture Lamp System", Ser. No. 10/698,773, filed on Oct. 31, 2003 and assigned to Honeywell International Inc. As another example, they can comprise dual flat lamps such as those described in co-pending patent application "Redundant Flat Lamp System", Ser. No. 10/698,770, filed on Oct. 31, 2003 and assigned to Honeywell International Inc.

Thus, the present invention provides a lamp driver system that facilitates improved reliability and performance for a display system. The lamp driver system includes a fault detector and an output steering device. The fault detector determines when a failure occurs in a lamp illuminating the display system. The output steering device selectively drives the lamps to illuminate the display system. Specifically, when a failure in a first lamp is detected by the fault detector, the output steering device is used to selectively drive a second lamp to provide the needed illumination to the display system. The lamp driver system thus can provide redundancy in the display system by automatically switching to a backup lamp when a failure in the first lamp is detected. This redundancy can improve the reliability and performance of the display system.

The embodiments and examples set forth herein were presented in order to best explain the present invention and its particular application and to thereby enable those skilled in the art to make and use the invention. However, those skilled in the art will recognize that the foregoing description and examples have been presented for the purposes of illustration and example only. The description as set forth is not intended to be exhaustive or to limit the invention to the precise form disclosed. Many modifications and variations are possible in light of the above teaching without departing from the spirit of the forthcoming claims.

What is claimed is:

1. A lamp driver system for selectively driving a first lamp and a second lamp, the lamp driver system comprising:

a fault detector, the fault detector coupled to the first lamp and the second lamp to determine when a failure occurs in the first lamp or the second lamp; and an output steering device, the output steering device selectively driving the first lamp and the second lamp in response to failures detected in the first lamp or the second lamp; and wherein the output steering device drives the first lamp until a failure in the first lamp is detected by the fault detector, and wherein the output steering device drives the second lamp when a failure is detected in the first lamp.

2. The lamp driver system of claim 1 wherein the first lamp and the second lamp comprise fluorescent lamps.

3. The lamp driver system of claim 1 wherein the first lamp and the second lamp comprise fluorescent lamps in a liquid crystal display system.

4. The lamp driver system of claim 1 wherein the fault detector is coupled to the first lamp and the second lamp through a first photo detector at the first lamp and a second photo detector at the second lamp.

5. The lamp driver system of claim 1 wherein the fault detector comprises a microcontroller configured to determine when a failure has occurred in the first or second lamp.

6. The lamp driver system of claim 1 wherein the output steering device comprises a programmable device that selectively directs an output of a power amplifier.

7. The lamp driver system of claim 6 wherein the programmable device comprises a microcontroller, a complex programmable logic device (CPLD), field programmable gate array (FPGA), or application specific integrated circuit (ASIC).

8. A lamp driver system for selectively driving a first lamp and a second lamp, the lamp driver system comprising:

a first controller, the first controller selectively driving the first lamp and the second lamp; and a fault detector, the fault detector coupled to the first lamp and the second lamp to determine when a failure occurs in the first lamp or the second lamp, and wherein the fault detected is coupled to the first controller to determine when a failure occurs in the first controller; and a second controller, second controller selectively driving the first lamp and the second lamp when a failure occurs in the first controller.

9. The lamp driver system of claim 8 wherein the first lamp and the second lamp comprises fluorescent lamps in a liquid crystal display.

10. The lamp driver system of claim 8 wherein the first controller further comprises a first output steering device, the first output steering device selectively controlling an output of the first controller to selectively drive the first lamp and the second lamp.

11. The lamp driver system of claim 10 wherein the second controller further comprises a second output steering device, the second output steering device selectively controlling an output of the second controller to selectively drive the first lamp and the second lamp.

12. The lamp driver system of claim 10 wherein the fault detector comprises a programmable device configured to determine when a failure has occurred in the first or second lamp and when a failure has occurred in the first controller.

13. The lamp driver system of claim 12 wherein the programmable device further selectively enables a power amplifier in the lamp driver system.

14. The lamp driver system of claim 12 wherein the programmable device comprises one of a group consisting of a microcontroller, a complex programmable logic device (CPLD), field programmable gate array (FPGA), or application specific integrated circuit (ASIC).

15. A lamp driver system for selectively driving a first lamp and a second lamp, the lamp driver system comprising:

a first controller, the first controller including:

a first fault detector, the first fault detector coupled to the first lamp and the second lamp to determine when a failure occurs in the first lamp or the second lamp;

a first output steering device, the first output steering device selectively driving the first lamp and the second lamp; and a second controller, the second controller including:

a second fault detector, the second fault detector coupled to the first lamp and the second lamp to determine when a failure occurs in the first lamp or the second lamp and coupled to the first controller to determine when a failure occurs in the first controller; and a second output steering device, the second output steering device selectively driving the first lamp and the second lamp.

16. The lamp driver system of claim 15 wherein the first fault detector and the first output steering device comprises a first programmable device configured to determine when a failure has occurred in the first or second lamp and when a failure has occurred in the second controller.

17. The lamp driver system of claim 16 wherein the second fault detector and the second output steering device comprises a second programmable device configured to determine when a failure has occurred in the first or second lamp and when a failure has occurred in the first controller.

18. The lamp driver system of claim 17 wherein the first programmable device and the second programmable device comprise one of a group consisting of a microcontroller, a complex programmable logic device (CPLD), field programmable gate array (FPGA), or application specific integrated circuit (ASIC).

19. The lamp driver system of claim 15 wherein the first lamp and the second lamp comprises fluorescent lamps in a liquid crystal display.

* * * * *